US005650762A

United States Patent [19]

Takahashi et al.

[11] Patent Number: 5,650,762

[45] Date of Patent: Jul. 22, 1997

[54] FIRE ALARM SYSTEM

[75] Inventors: Kaoru Takahashi; Yukihiko Usami, both of Tokyo, Japan

[73] Assignee: Nohmi Bosai Ltd., Tokyo, Japan

[21] Appl. No.: 409,154

[22] Filed: Mar. 23, 1995

[30] Foreign Application Priority Data

Mar. 29, 1994 [JP] Japan ..... 6-082321

[51] Int. Cl.[6] ..... G08B 26/00

[52] U.S. Cl. ..... 340/286.05; 340/505; 340/825.06

[58] Field of Search ..... 340/505, 506, 340/508, 511, 512, 513, 514, 588, 589, 825.06, 286.05

[56] References Cited

U.S. PATENT DOCUMENTS

| | | | |
|---|---|---|---|
| 3,516,063 | 6/1970 | Arkin et al. | 340/505 |
| 4,568,919 | 2/1986 | Muggli et al. | 340/505 |
| 4,916,432 | 4/1990 | Tice et al. | 340/506 |
| 4,977,527 | 12/1990 | Shaw et al. . | |

FOREIGN PATENT DOCUMENTS 0269747 6/1988 European Pat. Off. .

0616308 9/1994 European Pat. Off. .

*Primary Examiner*—Jeffery Hofsass
*Assistant Examiner*—Edward Lefkowitz
*Attorney, Agent, or Firm*—Wenderoth, Lind & Ponack

[57] ABSTRACT

A transmitter for use with a fire alarm system controls the monitoring of devices to be controlled based on a control command transmitted from a receiving section such as a fire receiver. With this transmitter, even if there is a short circuit in control lines for connecting the transmitter and the devices, it is not necessary to exchange fuses, and it is also possible to avoid the waste of power consumption which would otherwise incur during the actuation operation of the device(s). When the short circuit is recovered, the transmitter is able to correctly actuate the device(s). A small reverse current is permitted to flow in the control lines so as to enable the monitoring of a short circuit in the control lines by the transmitter. When the transmitter receives an actuation command from the receiving section, and if a short circuit in the control lines is detected, the transmitter goes into a standby state in which it holds an actuation signal for actuating the device(s) from being output to an actuating section. When the short circuit is recovered, the transmitter outputs the actuation signal to the actuating section.

8 Claims, 7 Drawing Sheets

BASIC OPERATION OF FIRE RECEIVER RE

BASIC OPERATION OF TRANSMITTER T

FIRE ALARM SYSTEM

BACKGROUND OF THE INVENTION

1. Field of the Invention

The present invention relates to a fire alarm system which has a receiving section such as a fire receiver, and a transmitter for controlling, based on a control command from the receiving section, the monitoring of devices to be controlled such as zone bells, which devices are employed as terminal devices.

2. Description of the Related Art

In a conventional so-called R-type fire alarm system, coded signals are transmitted and received between a receiving section, such as a receiver, and terminal devices so as to perform fire monitoring and status maintenance. Terminal devices such as a fire detector and the like, employed in the fire alarm system, are controlled by a microprocessor. Such a microprocessor-controlled system requires that the types and addresses of the terminal devices be stored in a predetermined storage area of a memory. By utilizing the types and addresses stored in the memory, the fire receiver is able to specify a terminal device according to a call signal provided with a corresponding address so as to collect information on a change in the status of the specified terminal device and to transmit a control command to the specified terminal device.

For example, when a zone alarm transmitter for controlling, for example, the actuation of the zone bells, receives from the fire receiver an alarm command along with the designation of an address, it actuates the zone bells corresponding to the transmitter to sound.

However, the conventional alarm system of the above type encounters the following problems. A possible short circuit occurring in control lines for connecting the transmitter and the corresponding zone bells causes the fuse to melt and be broken. This inevitably requires the replacement of fuses afterwards, which is troublesome and complicated. Also, the actuating operation to sound the zone bells is performed uselessly when a short circuit has occurred in the control lines or when a wire break in power lines for connecting the fire receiver and the transmitter has occurred, resulting in unnecessary power consumption.

Moreover, whenever the fire receiver sends an alarm command to the transmitter, it always indicates that devices to be controlled, such as zone bells, are sounding. Hence, if any of signal lines between the fire receiver and the transmitter is faulty, or if a voltage fault occurs at power lines of the transmitter, the zone bells do not actually sound, but the fire receiver provides a false indication that the zone bells are sounding. Namely, since the transmitter, based on the actuating operation thereof, reliably returns a response signal to the fire receiver, the fire receiver provides a false indication that the zone bells are sounding, though it actually is not.

The respective problems suffered by the conventional system as discussed above are most likely to arise when another type of object device, such as a smoke exhausting device, is employed instead of the zone bell. The same applies to the use of another type of receiving section, such as a transmitter, in place of the fire receiver.

SUMMARY OF THE INVENTION

Accordingly, in order to overcome the above drawbacks, an object of the present invention is to provide a fire alarm system and a transmitter employed therein which can eliminate the necessity of replacing fuses and also avoid the wasteful consumption of power which would otherwise incur during the actuation of device(s) to be controlled even if there is a short circuit in control lines for connecting the devices and a corresponding transmitter, the transmitter being also capable of performing a correct actuation of the device(s) when the short circuit is recovered.

Another object of the present invention is to provide a fire alarm system and a transmitter employed therein which can avoid the wasteful consumption of power which would otherwise incur during the actuation of device(s) to be controlled even if there is a break in power lines for connecting a fire receiver and the transmitter, and which is also capable of performing a correct actuation of the device (s) when the power line break is recovered.

A further object of the present invention is to provide a fire alarm system and a receiving section employed therein which can control device(s) to be controlled, such as zone alarm control device(s), employed in the fire alarm system in such a way that the receiving section indicates an operation of the device(s) only when the device(s) is actually in operation.

In order to achieve the above objects, according to a first aspect of the present invention, there is provided a fire alarm system including a receiving section and a transmitter connected to the receiving section for controlling the monitoring of terminal devices based on a control command transmitted from the receiving section, the receiving section comprising: a transmitting/receiving portion connected to the terminal devices for transmitting an actuation command to actuate the terminal device(s) and a status information return command to urge the terminal device(s) to return status information, and for receiving the status information returned from the terminal device(s); first indication means connected to the transmitting/receiving portion for indicating that the actuation command is being transmitted from the transmitting/receiving portion; and second indication means connected to the transmitting/receiving portion for indicating that the terminal device(s) being actuated in response to the actuation command, the transmitter comprising: a transmitting/receiving circuit connected to the receiving section for transmitting/receiving the control command to and from the receiving section; an actuating section connected to the transmitting/receiving circuit for actuating the terminal device(s) based on the actuation command transmitted from the receiving section; and at least one of a first monitoring section and a second monitoring section respectively connected to the actuating section, the first monitoring section allowing a small reverse current to flow in control lines connected to the terminal device(s) so as to monitor a short circuit in the control lines, the second monitoring section monitoring a wire break in power lines which receive power from the receiving section.

With this arrangement, when the transmitter receives the actuation command from the receiving section, and if a short circuit in the control lines is detected, the transmitter goes into a standby state in which it holds the actuation signal from being output to the device(s) to be controlled. Then, when the short circuit is recovered, the transmitter outputs the actuation signal to the actuating section. Hence, a possible short circuit in the control lines does not cause the fuse to melt and be broken, which thus eliminates the necessity of replacing fuses. It is also possible to avoid a waste of power consumption which would otherwise incur during the actuating operation of the device(s). When the short circuit is recovered, the transmitter is capable of correctly actuating the device(s).

Moreover, if there is a wire break in the power lines for connecting the receiving section and the transmitter, it is possible to avoid a possible waste of power consumption which would otherwise incur during the actuating operation of the device(s). When the wire break is recovered, the transmitter is able to correctly actuate the device(s).

Further, when controlling the device(s) used in the fire alarm system, the receiving section indicates that the device (s) is being actuated only when it actually is.

According to a second aspect of the present invention, there is provided a transmitter for use with a fire alarm system, for controlling the monitoring of terminal devices based on a control command transmitted from a receiving section, the transmitter comprising: a transmitting/receiving circuit connected to the receiving section through signal lines for transmitting/receiving the control command to and from the receiving section; an actuating section connected to the transmitting/receiving circuit for actuating the terminal device(s) based on an actuation command for actuating the terminal device(s) received from the receiving section; and a monitoring section connected to the actuating section for permitting a small reverse current to flow in control lines connected to the terminal device(s) so as to monitor a short circuit in the control lines, wherein the transmitter goes into a standby state in which it holds an actuation signal for actuating the terminal device(s) from being output to the actuating section when the transmitting/receiving circuit receives the actuation command from the receiving section and if a short circuit in the control lines is detected, and the transmitter outputs the actuation signal to the actuating section when the short circuit in the control lines is recovered.

With this arrangement, even if there is a short circuit in the control lines for connecting the transmitter and the corresponding devices, power is not supplied to the control lines, which prevents the fuse from being broken and thus eliminates the necessity of replacing fuses. It is also possible to avoid a possible waste of power consumption which would otherwise incur during the actuating operation of the device(s). When the short circuit is recovered, the transmitter is capable of performing a correct actuation of the device(s).

According to a third aspect of the present invention, there is provided a transmitter for use with a fire alarm system, for controlling the monitoring of terminal devices based on a control command transmitted from a receiving section, the transmitter comprising: a transmitting/receiving circuit connected to the receiving section through signal lines for transmitting/receiving the control command to and from the receiving section; an actuating section connected to the transmitting/receiving circuit for actuating the terminal device(s) based on an actuation command for actuating the terminal device(s) received from the receiving section; and a monitoring section connected to the actuating section for monitoring a wire break in power lines which receive power from the receiving section, wherein the transmitter goes into a standby state in which it holds an actuation signal for actuating the terminal device(s) from being output to the actuating section when the transmitting/receiving circuit receives the actuation command from the receiving section and if a wire break in the power lines is detected, and the transmitter outputs the actuation signal to the actuating section when the wire break in the power lines is recovered.

With this arrangement, even if there is a wire break in the power lines for connecting the receiving section and the transmitter, it is possible to avoid unnecessary power consumption which would otherwise incur during the actuating operation of the device(s) to be controlled. When the wire break is recovered, the transmitter is able to perform a correct actuation of the device(s).

According to a fourth aspect of the present invention, there is provided a transmitter for use with a fire alarm system, for controlling the monitoring of terminal devices based on a control command from a receiving section, the transmitter comprising: a transmitting/receiving circuit connected to the receiving section through signal lines for transmitting/receiving the control command to and from the receiving section; an actuating section connected to the transmitting/receiving circuit for actuating the terminal device(s) based on an actuation command for actuating the terminal device(s) received from the receiving section; a first monitoring section connected to the actuating section for permitting a small reverse current to flow in control lines connected to the terminal device(s) so as to monitor a short circuit in the control lines; and a second monitoring section connected to the actuating section for monitoring a wire break in power lines which receive power from the receiving section, wherein the transmitter goes into a standby state in which it holds an actuation signal for actuating the terminal device(s) from being output to the actuating section when the transmitting/receiving circuit receives the actuation command from the receiving section and if a short circuit in the control lines is detected, and the transmitter outputs the actuation signal to the actuating section when the short circuit in the control lines is recovered, and wherein the transmitter goes into a standby state in which it holds the actuation signal for actuating the terminal device(s) from being output to the actuating section when the transmitting/receiving circuit receives the actuation command from the receiving section and if a wire break in the power lines is detected, and the transmitter outputs the actuation signal to the actuating section when the wire break in the power lines is recovered.

With this arrangement, when the transmitter receives the actuation command from the receiving section, and if a short circuit in the control lines is detected, the transmitter goes into a standby state in which it holds the actuation signal from being output to the device(s) to be controlled. When the short circuit is then recovered, the transmitter outputs the actuation signal for actuating the device(s) to the actuating section. Hence, a possible short circuit in the control lines does not cause the fuse to melt and be broken, which further eliminates the replacement of fuses. It is also possible to avoid the waste of power consumption which would otherwise incur during the actuating operation of the device(s). When the short circuit is recovered, the transmitter is able to correctly actuate the device(s).

Moreover, even if there is a wire break in the power lines for connecting the receiving section and the transmitter, it is possible to avoid unnecessary power consumption which would otherwise incur during the actuating operation of the device(s). When the wire break is recovered, the transmitter is capable of performing a correct actuation of the device(s).

Further, when controlling the device(s) used in the fire alarm system, the receiving section indicates that the device (s) is being actuated only when the device is actually in operation.

According to a fifth aspect of the present invention, there is provided a receiving section for use with a fire alarm system, connected to various types of terminal devices via signal lines and calling the terminal devices according to a polling method so as to collect predetermined information and to execute predetermined control, the receiving section comprising: a transmitting/receiving portion connected to the receiving section for transmitting an actuation command to actuate the terminal device(s) and a status information return command to urge the terminal device(s) to return status information, and for receiving the status information returned from the terminal device(s); first indication means connected to the transmitting/receiving portion for indicating that the actuation command is being transmitted; and second indication means connected to the transmitting/receiving portion for indicating the terminal device(s) being actuated in response to the actuation command.

With this arrangement, when controlling the device(s) used in the fire alarm system, the receiving section indicates that the device(s) is being actuated only when the device is actually in operation.

DESCRIPTION OF THE PREFERRED EMBODIMENTS

Figure 1:
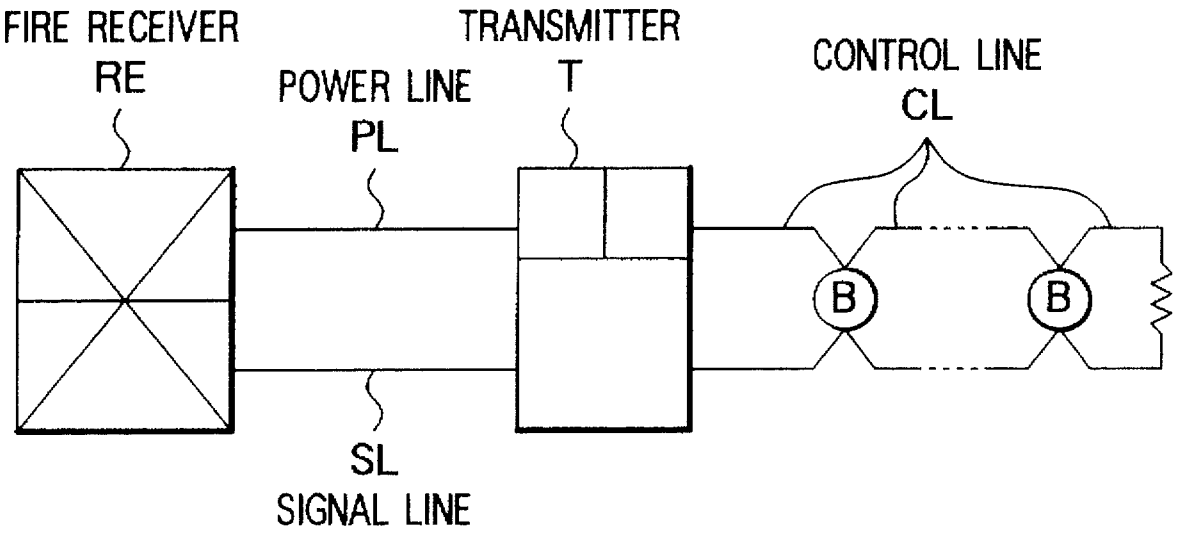
FIG. 1 schematically illustrates the general arrangement of a fire receiver RE, a transmitter T and zone bells B.

FIG. 1 schematically illustrates the general arrangement of a fire receiver RE, a transmitter T and zone bells B.

In this embodiment, the fire receiver RE is connected to the transmitter T used as terminal devices via signal lines SL so that the fire receiver RE calls the terminal devices according to a polling method so as to collect predetermined information and to execute predetermined control. Power lines PL and the signal lines SL are provided to connect the fire receiver RE and the transmitter T, while control lines CL are provided to connect the transmitter T and the respective zone bells B, which are each representative of devices to be controlled.

Figure 2:
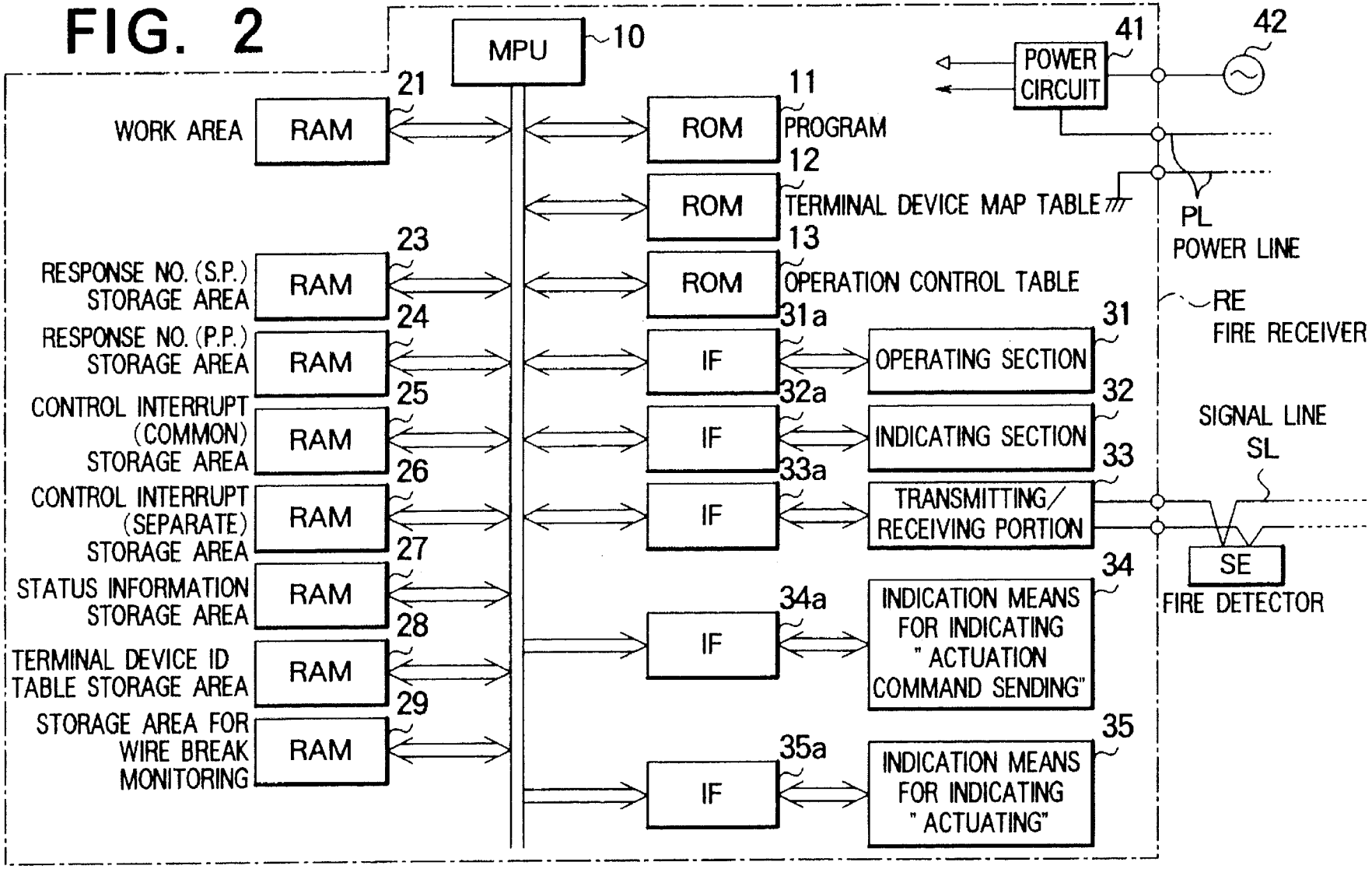
FIG. 2 is a block diagram illustrative of the fire receiver RE according to one embodiment of the present invention.

FIG. 2 is a block diagram illustrative of the fire receiver RE according to an embodiment of the present invention.

The fire receiver RE comprises: a MPU (microprocessor) 10; ROMs 11–13; RAMs 21, 23–29; an operating section 31 adapted to be manipulated by an operator; an indicating section 32; a transmitting/receiving section 33; a first indication means 34 for presenting an indication "sending an actuation command"; a second indication means 35 for presenting an indication "actuating"; interfaces (IFs) 31*a*–35*a* of these section and means 31–35; and a power circuit 41.

Figure 4:
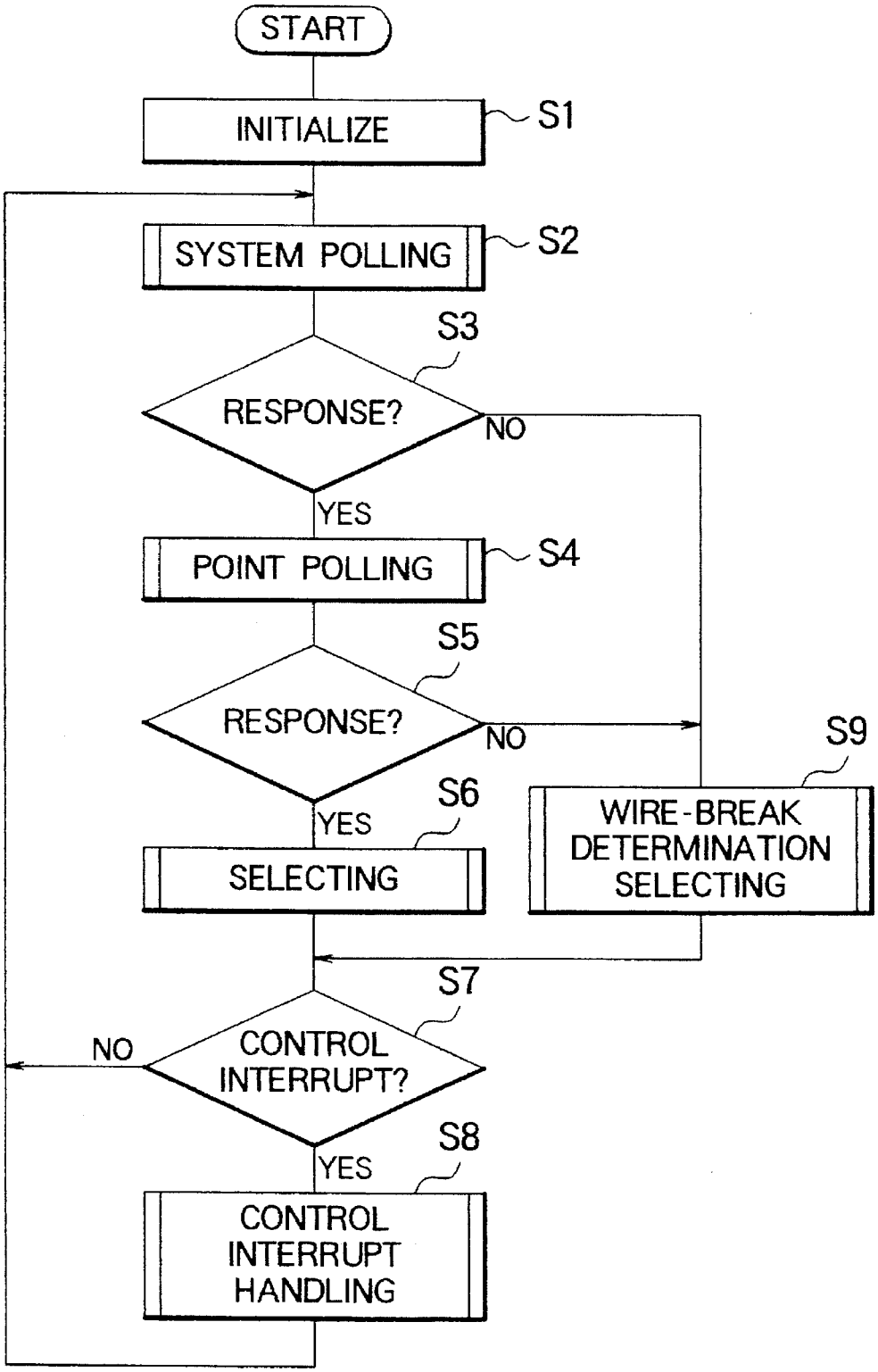
FIG. 4 is a flow chart illustrative of the basic operation of the fire receiver RE according to the same embodiment.
Figure 5:
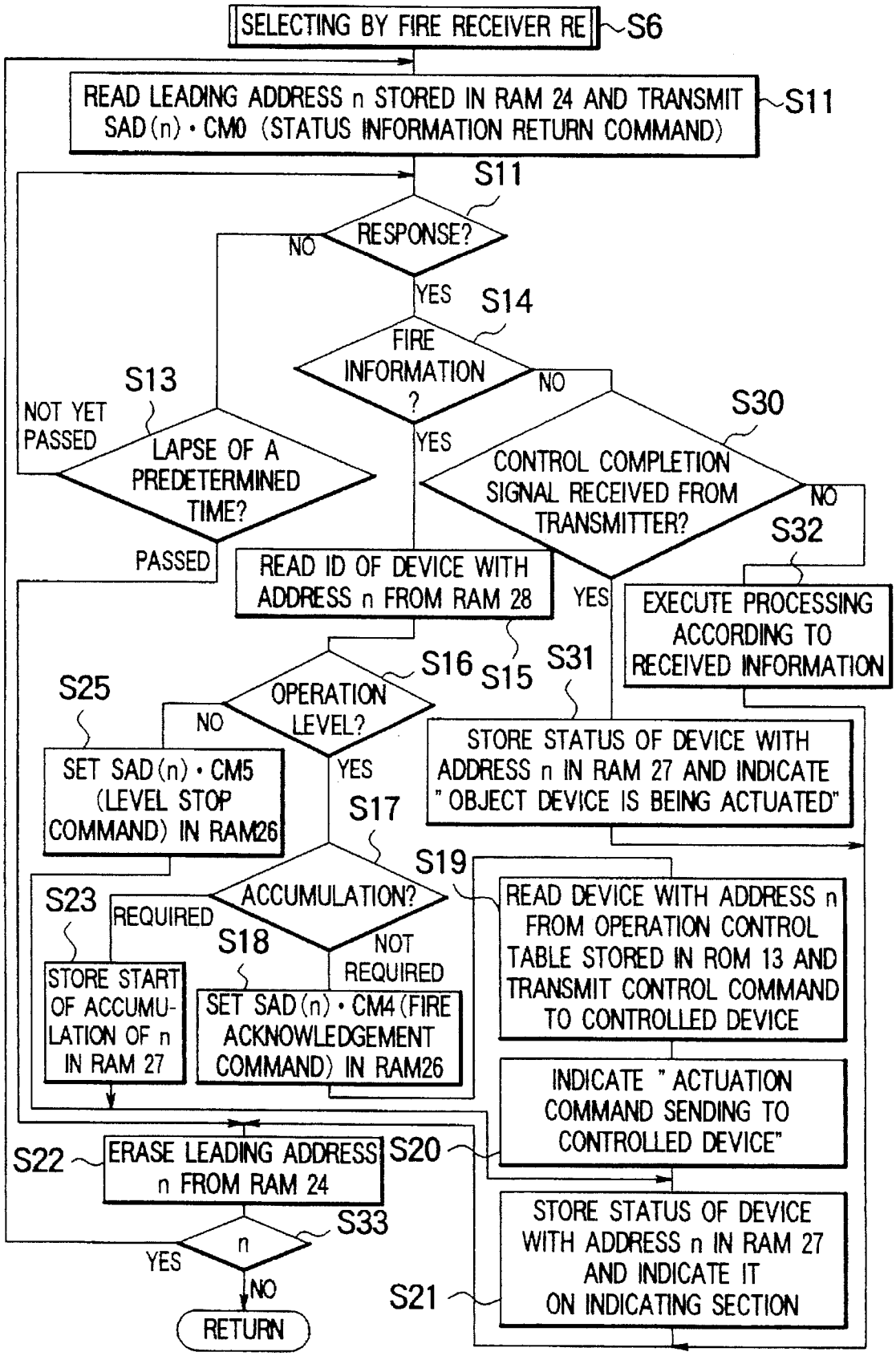
FIG. 5 is a flow chart illustrative of a specific example of the processing of the selecting operation (S6) executed by the fire receiver RE employed in the same embodiment.

The ROM 11 is a storage area that stores programs related to the flow charts shown in FIGS. 4 and 5. The ROM 12 is a terminal device-map-table storage area that stores respective addresses of terminal devices, such as the fire detector SE, the transmitter T and a smoke exhausting device and the like, as well as IDs such as the type of the terminal devices, when initialization is performed. The ROM 13 is a storage area that stores an operation control table for sequentially controlling the operations of devices to be controlled, such as a smoke exhausting device, based on a fire signal transmitted from terminal device(s).

A brief explanation will now be given of the polling/selecting method employed in this embodiment. This method is based on the principle that terminal devices connected to the fire receiver RE have been divided into a plurality of groups, and only a terminal device(s) whose status has been changed responds to a call from the fire receiver RE. The response timing of each terminal device varies depending upon the polling method employed, i.e., system polling or point polling. In system polling, the response timing of each terminal device varies group by group, whereas in point polling, the timing varies terminal device by terminal device. If, according to the system polling, there is no response from the terminal devices whatsoever, the status of none of the terminal devices has changed. On the other hand, if a response is returned from a terminal device group upon system polling, it can be assumed that the status of one or more of the terminal devices which belong to the group has changed. Thus, the fire receiver RE calls one by one for transmissions (i.e., point calling) from all the terminal devices belonging to the group.

Returning to FIG. 2, the RAM 21 is a work area. The RAM 23 is a storage area that stores, based on the timing at which a pulse is received, the group number g of the terminal device group including any terminal device which has sent a response signal during the point polling. On the other hand, the RAM 24 is a storage area that stores, based on the timing at which a response pulse is received, the terminal device number m in the group in which any of the terminal devices have sent a response signal during the point polling. The RAM 25 is a storage area that stores contents of the control which is executed during the system polling. The RAM 26 is a storage area that stores the terminal device numbers of the terminal devices to be controlled according to the polling/selecting method and also stores contents of the control to be executed (for example, a test command, a fire acknowledgement command and a level stop command). The RAM 27 is a storage area that stores the status information collected from the respective terminal devices.

The RAM 28 is a storage area that stores the addresses and IDs of the terminal devices connected to the fire receiver RE. After initialization, the contents of the data stored in the RAM 28 are continuously updated in response to the information collected according to a wire break monitoring selecting method. The RAM 29 is a storage area that stores the address of any terminal device which is determined to have a wire break according to the wire break monitoring selecting method.

The transmitting/receiving portion 33 transmits an actuation command for actuating device(s) used as terminal device(s), and also transmits a status information response command for urging the device(s) to return its status information. The transmitting/receiving portion 33, on the other hand, receives such status information returned from the device(s).

The indication means 34 is used to provide an indication "sending an actuation command" when the fire receiver RE sends an actuation command to predetermined device(s) to be controlled. The indication is canceled when the device(s) is actuated.

The indication means 35 is used to indicate that the device(s) is actuated when the fire receiver RE receives from the transmitter T a signal indicating that the device(s) has been actuated after receiving the actuation command from the fire receiver RE. The indication is canceled when the actuating status of the device(s) is interrupted or completed.

The power circuit 41 obtains AC power from a commercial power source 42 located exterior of the fire receiver RE and rectifies and smooths it so as to obtain a predetermined DC voltage which supplies DC power to the terminal devices, such as the transmitter T and the fire detector SE, via the power lines PL.

Figure 3:
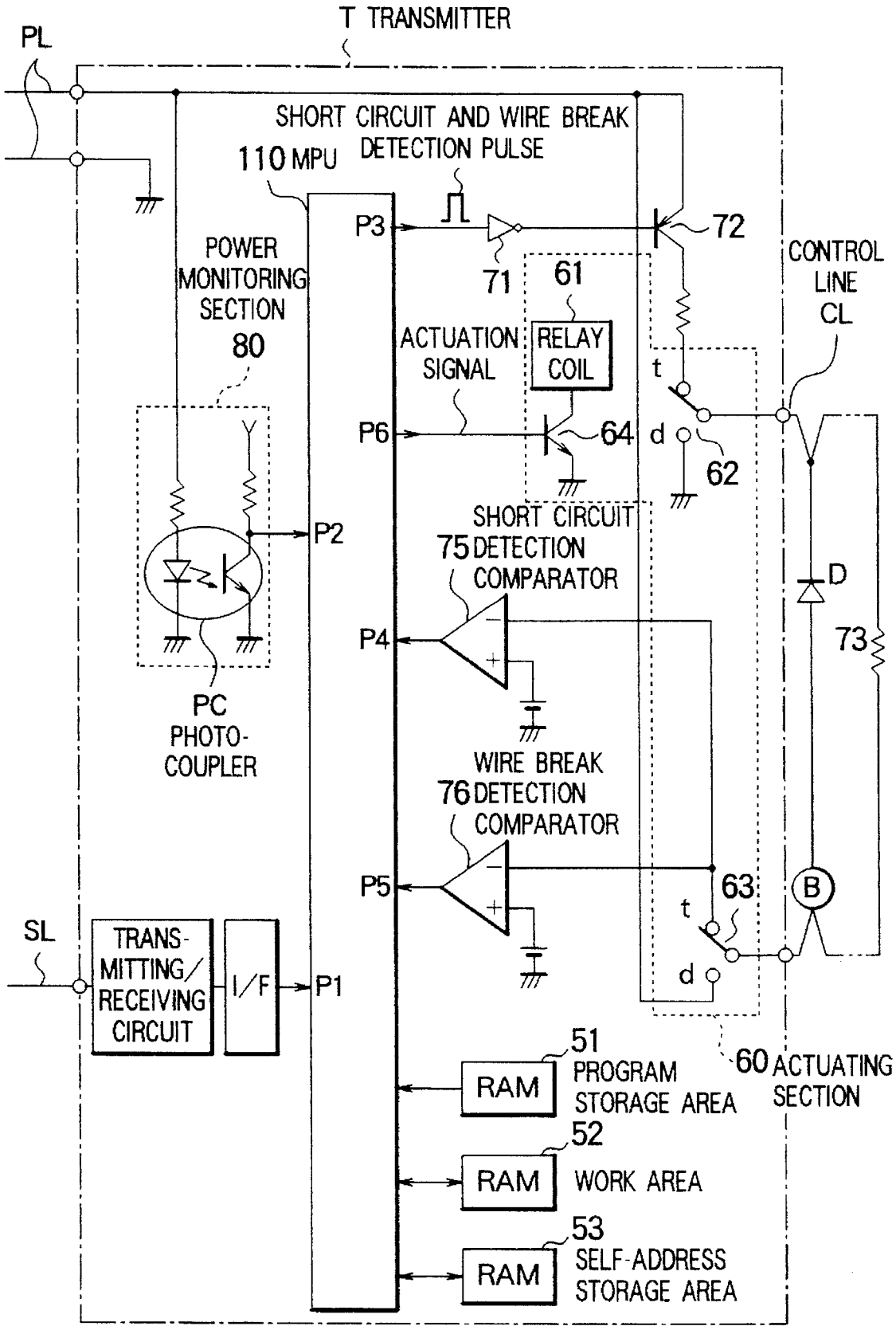
FIG. 3 is a block diagram illustrative of the transmitter T according to the same embodiment.

FIG. 3 is a block diagram illustrative of the transmitter T employed in this embodiment.

The transmitter T is employed to control the monitoring of the devices to be controlled based on a control command from the fire receiver RE. The transmitter T comprises a MPU (microprocessor) 110, a ROM 51, RAMs 52 and 53, a transmitting/receiving circuit 54, an interface (IF) 55 for the transmitting/receiving circuit 54, an actuating section 60, a short-circuit and wire break detecting section to be described later, and a power monitoring section 80.

Figure 6:
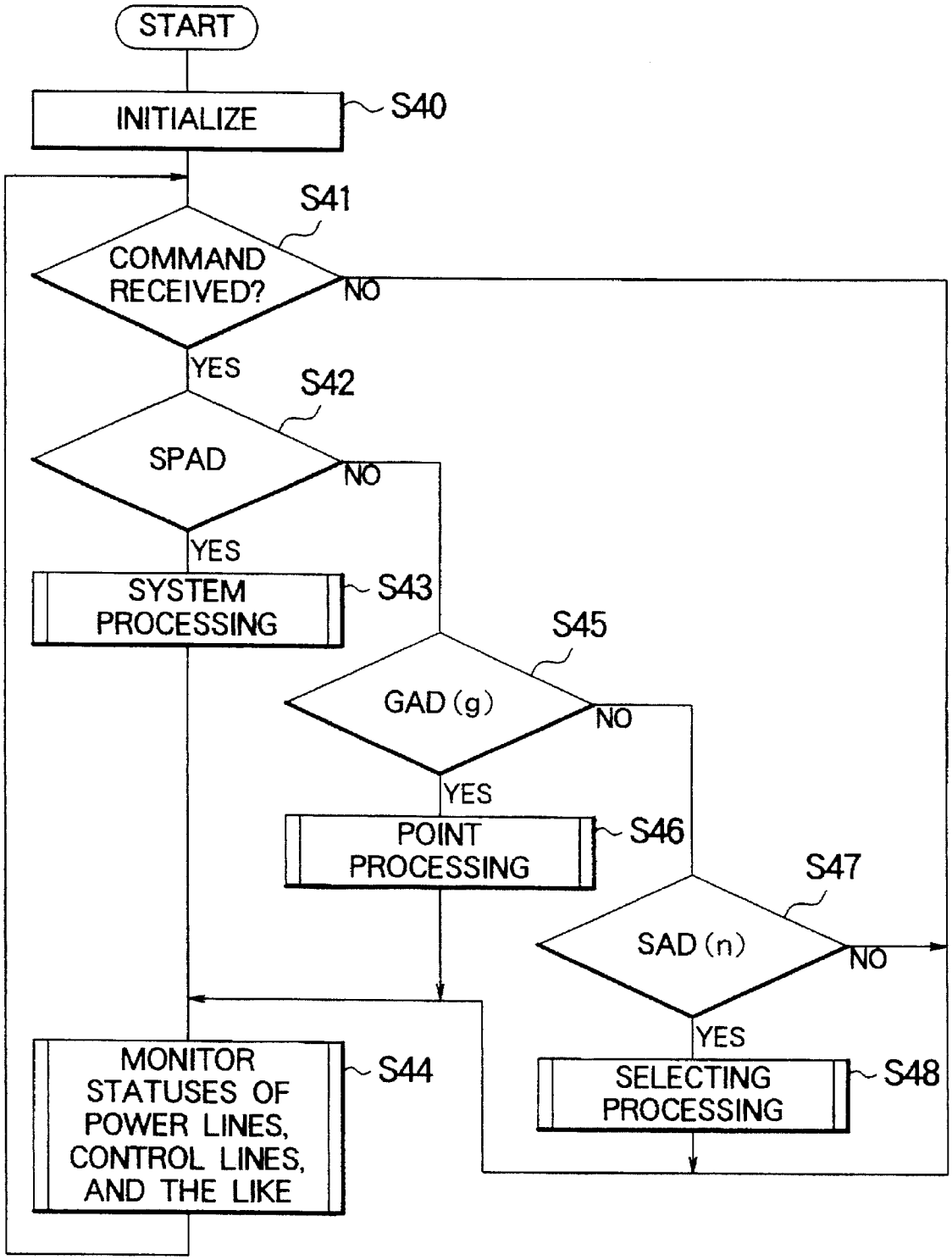
FIG. 6 is a flow chart illustrative of the basic operation of the transmitter T according to the same embodiment.
Figure 7:
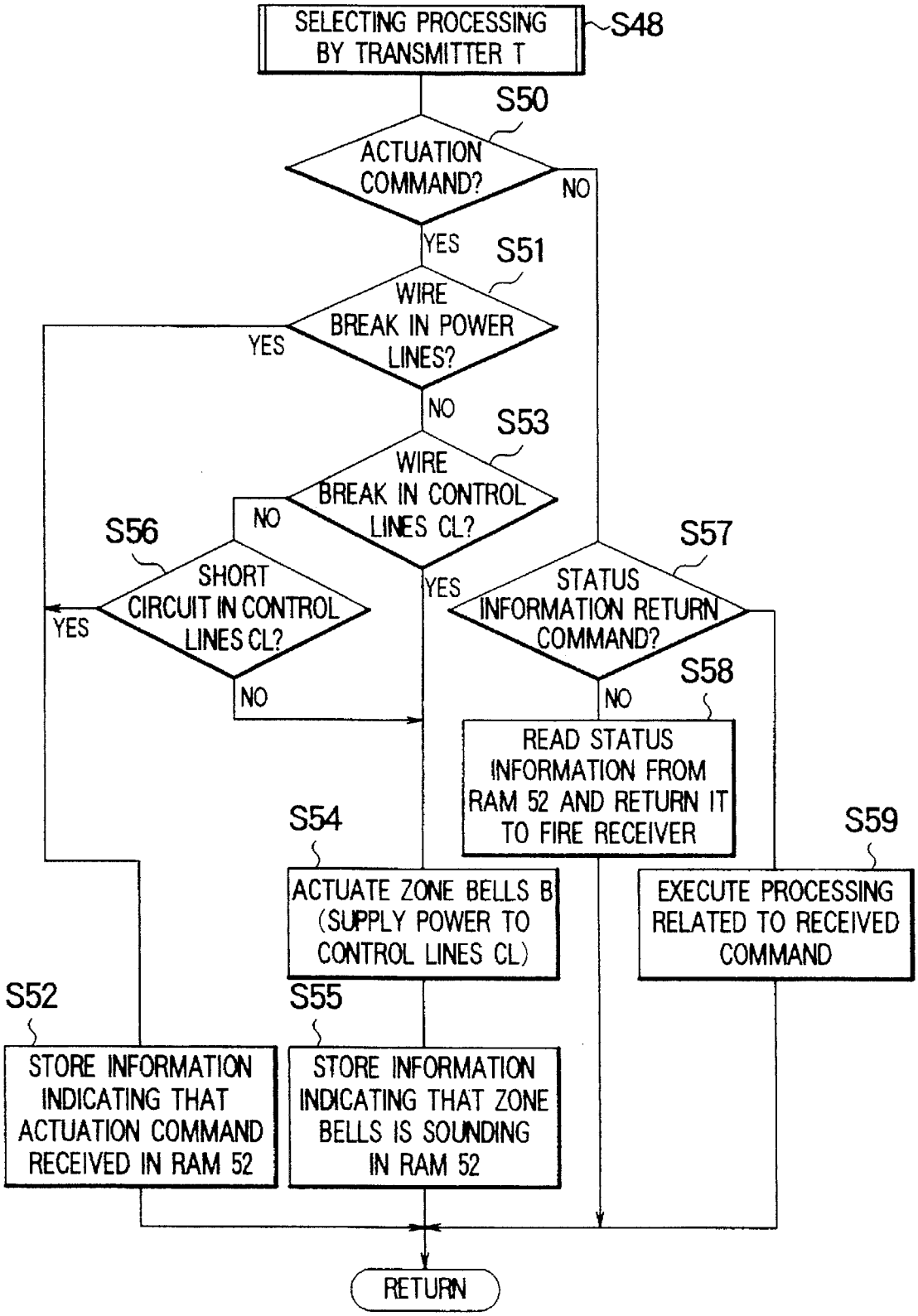
FIG. 7 is a flow chart illustrative of the processing of the selecting operation (S48) executed by the transmitter T employed in the same embodiment.

The MPU 110 controls the entire transmitter T, and also executes the programs related to the flow charts shown in FIGS. 6 and 7. The ROM 51 is a storage area that stores the programs related to the flow charts shown in FIGS. 6 and 7. The RAM 52 is a work area, while the RAM 53 is an area that stores the self-address of the transmitter T.

The transmitting/receiving circuit 54 transmits and receives predetermined commands and data to and from the fire receiver RE, the circuit being representative of a transmitting/receiving circuit of the type which transmits and receives control commands and the like to and from a receiving section via signal lines.

The actuating section 60 actuates the zone bells B when it receives an actuation signal from a port P6 of the MPU 110 based on an actuation command from the fire receiver RE. The actuating section 60 comprises a relay coil 61, switches 62 and 63 corresponding to the coil 61, and a transistor 64 for controlling the power supply to the relay coil 61. The type of the relay used in the actuating section 60 is a latching relay. The switches 62 and 63 are normally (i.e., during the detection of a wire break and a short circuit in control lines CL) connected to detection terminals t. On the other hand, the switches 62 and 63 are connected to actuation terminals d when actuating zone bells B. When the actuating section 60 receives an actuation command from the fire receiver RE, an actuation signal for actuating the zone bells B is output from the port P6, causing the transistor 64 to be turned on, which further urges the relay coil 61 to connect the switches 62 and 63 to the actuation terminals d.

The short-circuit and wire break detecting section as described above mainly comprises a short-circuit detection comparator 75 and a wire break detection comparator 76. In addition, the detecting section includes: an inverter 71 for inverting a positive detection pulse which is output from a port P3 of the MPU 110 upon detection of a short-circuit or a wire break; a transistor 72 for controlling a current used for a short-circuit and wire break detection; and an end-of-line resistor 73 connected in parallel to the zone bells B. A plurality of zone bells B are connected in parallel to the control lines CL, and a diode D is connected in series to a corresponding zone bell B. This diode D prevents the flow of a current to the zone bells B upon detection of a short circuit or a wire break. The above-described short-circuit and wire break detecting section represents a monitoring section for monitoring a short circuit in the control lines CL by permitting a small reverse current to flow in the control lines CL used for connecting the transmitter T and the devices to be controlled.

The power monitoring section 80 detects whether a voltage has been applied to the power lines PL. More specifically, the photocoupler PC detects a voltage of the power lines PL so as to apply a detection signal to an input port P2 of the MPU 110. Namely, the power monitoring section 80 represents a section for monitoring a wire break in the power lines which receive power from the fire receiver.

When the transmitting/receiving circuit 54 receives an actuation command from the fire receiver RE so as to actuate device(s), the MPU 110 executes the following types of processing upon detection of a short circuit in the control lines CL by means of the short circuit detecting section or upon a wire break in the power lines PL by means of the power monitoring section 80. That is, if a short circuit in the control lines CL is detected, the MPU 110 goes into a standby state in which it holds an actuation signal from being output to the actuating section 60 which would otherwise actuate the zone bells B. When the detected short circuit is then recovered, the MPU 110 outputs such an actuation signal to the actuating section 60. On the other hand, if a wire break in the power lines PL is detected, the MPU 110 goes into a standby state in which it holds an actuation signal from being output to the actuating section 60 which would otherwise actuate the zone bells B. When the detected wire break is then recovered, the MPU 110 outputs such an actuation signal to the actuating section 60.

The operation of the present embodiment will now be described. An explanation will first be given of the operation of the fire receiver RE with reference to FIGS. 4 and 5.

FIG. 4 is a flow chart illustrative of the basic operation of the fire receiver RE.

The initialization is first performed in step S1, followed by executing system polling (S2). If there is a response from any terminal device to the system polling executed in step S2 (S3), point polling is executed on a group which has responded to system polling executed in step S2 (S4). If there is a response from any terminal device to point polling executed in step S4 (S5), selection is executed on any terminal device which has responded to point polling so as to urge such terminal device(s) to return its status information (S6). If a control interrupt occurs (S7), such a control interrupt is handled (S8). Then, the flow returns to system polling (S2). If there is no response to system polling (S3), it is determined that the status has not changed on any terminal devices, and thus, selecting operation is sequentially executed on all of the individual terminal devices one by one to determine whether there is a wire break (S9).

In the above-described selecting operation (S6), an actuation command is sent to a device to be controlled. If the device has not been actuated, the indication means 34 provides an indication "actuation command sending", and if the device has already been actuated in response to the actuation command, the indication means 35 provides an indication "actuating".

FIG. 5 is a flow chart illustrative of a routine of the selecting operation (S6) executed by the fire receiver RE in this embodiment.

The fire receiver RE designates a leading address n read from the addresses of the terminal devices which have responded during point polling (S4 in FIG. 4) and which have been stored in the RAM 24 so as to send a selecting command SAD (n)·CM0 indicative of a status information return command (S11). If there is any response from the terminal devices having the designated address n which has been called during selecting (S12), and if such response indicates fire information (S14), the ID of the terminal devices (the type of the terminal devices, such as a smoke detector, a heat detector or the like) provided with the address n is read from the RAM 28 (S15).

If the fire information from the fire detector SE reaches a set operation level (S16), and if the fire information is not required to be accumulated (S17), it is determined with certainty that a fire has occurred, and the terminal device provided with the address n acknowledges that a fire has definitely occurred. Accordingly, a fire acknowledgement command SAD(n)·CM4 is set in the RAM 26 (S18), the command being used for preventing the terminal device having the address n from responding to system polling and point polling. A device to be controlled according to a fire signal from the terminal device having the address n (devices to be controlled have been assigned to respective corresponding terminal devices so as to be operated in cooperation with each other) is read from the control table stored in the ROM 13. The thus read data on the devices is then sent to the transmitting/receiving portion 33, and a control command is sent to the device(s) via the transmitter T (S19).

The indication means 34 provides an indication "actuation command sending" indicating that an actuation command is being sent to the device(s) (S20). This is for the following reason. Although the fire receiver RE has completed the operation of sending an actuation command to the transmitter T, it has not yet received from the transmitter T a signal indicative of the completion of the actuation control. It is thus still unknown to the fire receiver RE whether the associated zone bells B have been actuated. Therefore, only an indication of "actuation command sending" is provided by the indication means 34, but an indication of "device actuating" is not yet provided by the indication means 35.

As is seen from the foregoing description, only an indication of "actuation command sending" is provided in the stage in which the fire receiver RE has sent an actuation command to the transmitter T. This can prevent the erroneous recognition of the actuation of the associated zone bells B, as viewed from the fire receiver RE.

Along with an indication of "actuation command sending", the zone bells B which have been sent the actuation command may be indicated.

Subsequently, the status of the terminal device having the address n is stored in the RAM 27 and is indicated on the indicating section 32 (i.e. fire zone or address n) (S21). The leading n is then erased from the RAM 24 (S22).

On the other hand, if the fire information from the fire detector SE does not reach the set operation level (S16), SAD(n)·CM5 indicative of a level stop command is set in the RAM 26 (S25).

In contrast to the flow described above, although there is a response from the terminal device having the address n during selecting, the content of the response is not related to fire information (S14), and instead, it is a signal indicative of the completion of the control of the zone bells B received from the transmitter T (S30). In such a case, the status of the zone bells B having the address n, that is, information indicating that the zone bells B are sounding, is stored in the RAM 27, and the indication means 35 indicates "device being actuated" (S31).

As described above, when the fire receiver RE receives from the transmitter T a signal indicative of the completion of the control on the zone bells B, the fire receiver RE indicates "device being actuated" through the indication means 35. It is thus possible to recognize the actuation of the associated zone bells B, as viewed from the fire receiver RE.

If in step S30 the received signal is not a control completion signal, the processing is executed according to the content of the received signal (S32). If there remains any address n in the RAM 24, the operations in steps S11–S31 required for completing the processing for such a remaining address n are repeated (S33).

An explanation will now be given of the operation of the transmitter T with reference to FIGS. 6 and 7.

FIG. 6 is a flow chart illustrative of the basic operation of the transmitter T.

Initialization is first performed (S40), and it is determined whether the transmitter T has received a command from the fire receiver RE (S41). If the answer to this question is positive, it is further determined whether the command received is a command SPAD indicative of the execution of system polling (S42), and if so, the system processing is executed (S43). Thereafter, the sensor processing, such as monitoring the statuses of the power lines PL, the control lines CL and the like is executed (S44), and the flow returns to step S41. On the other hand, if the command received from the fire receiver RE is not a command SPAD (S42), it is further determined whether the received command is a command GAD (g) indicative of point polling in which a group including the transmitter T is designated (S45). If the answer to this question is positive, the point processing is executed (S46). If, however, the signal received from the fire receiver RE is not a command GAD (g) (S45), it is then determined whether the received signal is a command SAD (n) indicative of the execution of selecting in which a self-address of the transmitter T is designated (S47), and if so, the selecting processing is executed (S48).

FIG. 7 is a flow chart illustrative of one example of a routine of the selecting operation (S48) executed by the transmitter T in this embodiment.

When the transmitting/receiving circuit 54 of the transmitter T receives from the fire receiver RE an actuation command for actuating device(s) to be controlled (S50), and if a wire break in the power lines PL is detected by the power monitoring section 80 (S51), the MPU 110 goes into a standby state in which it holds an actuation signal from being output to the actuating section 60, and information indicating that the transmitting/receiving circuit 54 has received the actuation command from the fire receiver RE is stored in the RAM 52. Then, the control returns to the main routine.

When the wire break detection comparator 76 detects a wire break in the control lines CL (S53), the zone bells B are actuated to sound (S54). To put it more specifically, the MPU 110 outputs an actuation signal through an output port P6 so as to turn the transistor 64 on, causing the power to be supplied to the relay coil 61 so as to change the switches 62 and 63 from the detection terminals t to the actuation terminals d. Accordingly, a current flows in the order from the positive line of the power lines PL, the switch 63, the zone bells B and the diodes D, the switch 62 to the negative line of the power lines PL, so that power is supplied to the control line CL, thereby permitting the zone bells B to sound. Information indicating that the zone bells B are sounding is then stored in the RAM 52 (S55). Subsequently, the control returns to the main routine.

As is seen from the foregoing description, the zone bells B are actuated even though a wire break in the control lines CL is detected. This is for the following reason. Although it is possible to detect whether a wire break has occurred in the control lines CL, it is not determined which portion of the line CL has a wire break. Therefore, depending on the position of the wire break, some of the zone bells B may be actuated upon supplying power to the control lines CL.

If a wire break in the control lines CL is not detected (S53), a short circuit in the control lines CL is detected by the short-circuit detection comparator 75 (S56). If a short circuit is not detected, the zone bells B are actuated (S54).

If a possible wire break in the power lines PL and a possible short circuit in the control lines CL (S51, S56) are recovered, the MPU 110 outputs an actuation signal to the actuating section 60 so as to actuate the zone bells B (S54).

In contrast to the processing described above, if the transmitter T does not receive from the fire receiver RE an actuation command (S50), but instead receives a status information return command (S57), such status information is read from the RAM 52 and is returned to the fire receiver RE (S58). If a command other than the status information return command is received (S57), the processing related to the received command is executed (S59). The control then returns to the main routine.

In this embodiment, in place of the zone bells B, another type of devices to be controlled, such as a smoke exhausting device and the like, may be controlled. Additionally, instead of the fire receiver RE, another type of receiving section such as a transmitter may be employed.

What is claimed is:

1. A fire alarm system including a receiving section and a transmitter connected to said receiving section for controlling the monitoring of terminal devices based on a control command transmitted from said receiving section, said receiving section comprising:

a transmitting/receiving portion connected to said terminal devices for transmitting an actuation command to actuate at least one of said terminal devices and a status information return command to urge at least one of said terminal devices to return status information, and for receiving the status information returned from at least one of said terminal devices;

first indication means connected to said transmitting/receiving portion for indicating that the actuation command is being transmitted from said transmitting/receiving portion; and second indication means connected to said transmitting/receiving portion for indicating that at least one of said terminal devices is being actuated in response to the actuation command, said transmitter comprising:

a transmitting/receiving circuit connected to said receiving section for transmitting/receiving the control command to and from said receiving section;

an actuating section connected to said transmitting/receiving circuit for actuating at least one of said terminal devices based on the actuation command transmitted from said receiving section; and at least one of a first monitoring section and a second monitoring section respectively connected to said actuating section, said first monitoring section allowing a small reverse current to flow in control lines connected to said terminal devices so as to monitor a short circuit in said control lines, said second monitoring section monitoring a wire break in power lines which receive power from said receiving section.

2. A transmitter for use with a fire alarm system, for controlling the monitoring of terminal devices based on a control command transmitted from a receiving section, said transmitter comprising:

a transmitting/receiving circuit connected to said receiving section through signal lines for transmitting/receiving the control command to and from said receiving section;

an actuating section connected to said transmitting/receiving circuit for actuating at least one of said terminal devices based on an actuation command for actuating at least one of said terminal devices received from said receiving section; and a monitoring section connected to said actuating section for permitting a small reverse current to flow in control lines connected to said terminal devices so as to monitor a short circuit in said control lines, wherein said transmitter goes into a standby state in which it holds an actuation signal for actuating at least one of said terminal devices from being output to said actuating section when said transmitting/receiving circuit receives the actuation command from said receiving section and if a short circuit in said control lines is detected, and said transmitter outputs the actuation signal to said actuating section when the short circuit in said control lines is recovered.

3. A transmitter for use with a fire alarm system, for controlling the monitoring of terminal devices based on a control command transmitted from a receiving section, said transmitter comprising:

a transmitting/receiving circuit connected to said receiving section through signal lines for transmitting/receiving the control command to and from said receiving section;

an actuating section connected to said transmitting/receiving circuit for actuating at least one of said terminal devices based on an actuation command for actuating at least one of said terminal devices received from said receiving section; and a monitoring section connected to said actuating section for monitoring a wire break in power lines which receive power from said receiving section, wherein said transmitter goes into a standby state in which it holds an actuation signal for actuating at least one of said terminal devices from being output to said actuating section when said transmitting/receiving circuit receives the actuation command from said receiving section and if a wire break in said power lines is detected, and said transmitter outputs the actuation signal to said actuating section when the wire break in said power lines is recovered.

4. A transmitter for use with a fire alarm system, for controlling the monitoring of terminal devices based on a control command from a receiving section, said transmitter comprising:

a transmitting/receiving circuit connected to said receiving section through signal lines for transmitting/receiving the control command to and from said receiving section;

an actuating section connected to said transmitting/receiving circuit for actuating at least one of said terminal devices based on an actuation command for actuating at least one of said terminal devices received from said receiving section;

a first monitoring section connected to said actuating section for permitting a small reverse current to flow in control lines connected to said terminal devices so as to monitor a short circuit in said control lines; and a second monitoring section connected to said actuating section for monitoring a wire break in power lines which receive power from said receiving section, wherein said transmitter goes into a standby state in which it holds an actuation signal for actuating at least one of said terminal devices from being output to said actuating section when said transmitting/receiving circuit receives the actuation command from said receiving section and if a short circuit in said control lines is detected, and said transmitter outputs the actuation signal to said actuating section when the short circuit in said control lines is recovered, and wherein said transmitter goes into a standby state in which it holds the actuation signal for actuating at least one of said terminal devices from being output to said actuating section when said transmitting/receiving circuit receives the actuation command from said receiving section and if a wire break in said power lines is detected, and said transmitter outputs the actuation signal to said actuating section when the wire break in said power lines is recovered.

5. A transmitter for use with a fire alarm system according claim 1, wherein said transmitter outputs an actuation signal to said actuating section for actuating at least one of said terminal devices when a wire break in said control lines is recovered.

6. A transmitter for use with a fire alarm system according to claim 2, wherein said transmitter outputs the actuation signal to said actuating section when a wire break in said control lines is recovered.

7. A transmitter for use with a fire alarm system according to claim 3, wherein said transmitter outputs the actuation signal to said actuating section when a wire break in said control lines is recovered.

8. A transmitter for use with a fire alarm system according to claim 4, wherein said transmitter outputs the actuation signal to said actuating section when a wire break in said control lines is recovered.

* * * * *